United States Patent [19]

Ferguson

[11] 4,135,431

[45] Jan. 23, 1979

[54] STRINGED MUSICAL INSTRUMENT PICK DISPENSER

[76] Inventor: Richard R. Ferguson, 3602 Raymond, Fort Wayne, Ind. 46803

[21] Appl. No.: 732,585

[22] Filed: Oct. 15, 1976

[51] Int. Cl.[2] ..... G10D 3/00

[52] U.S. Cl. ..... 84/329; 84/322; 206/817; 312/71

[58] Field of Search ..... 84/322, 329; 133/5 A, 133/6; 221/279; 312/71; 206/445, 817

[56] References Cited

U.S. PATENT DOCUMENTS

| | | | |
|---|---|---|---|
| 191,336 | 5/1877 | Guild | 133/6 |
| 1,432,498 | 10/1922 | Szepe | 133/6 |
| 3,181,410 | 5/1965 | Phillips | 84/329 X |
| 3,248,156 | 4/1966 | Repko | 312/71 |

OTHER PUBLICATIONS

Wexler Catalog #66, 1965–1966, p. 137.
The Music Trades, Apr. 1972, p. 86.

*Primary Examiner*—Lawrence R. Franklin
*Attorney, Agent, or Firm*—Albert L. Jeffers; Richard T. Seeger

[57] ABSTRACT

A stringed musical pick or plectrum dispenser for receiving, retaining, and dispensing a pick, the dispenser being mounted in fixed relation to an instrument sound board adjacent the instrument strings. Each pick is wafer thin and generally triangular in shape. The dispenser may be mounted on a pick guard which has a first edge alignable with the instrument string that is last plucked to guard against, and prevent, continued downward travel of the pick thus protecting the finish on the instrument sound board. A dispenser housing has a perimetral wall with upper and lower edges. The housing defines in cross-section the general configuration of a pick. A bottom side is affixed to the lower wall edge and a top side is affixed to the upper wall edge. A pick receiving and dispensative opening is formed in the top side. The opening receives a pick and provides an inner surface for engaging and retaining the pick in the dispenser while exposing a pick surface through the opening. Resilient means are mounted in the housing for exerting a uniform resilient force against the pick urging it towards the retaining surface. The housing is mounted to the pick guard adjacent a second guard edge opposite the first edge with the dispensative opening being more distant from the first edge than the retaining surface so that the dispensative direction of the pick is away from the first edge.

1 Claim, 8 Drawing Figures

FIG.1
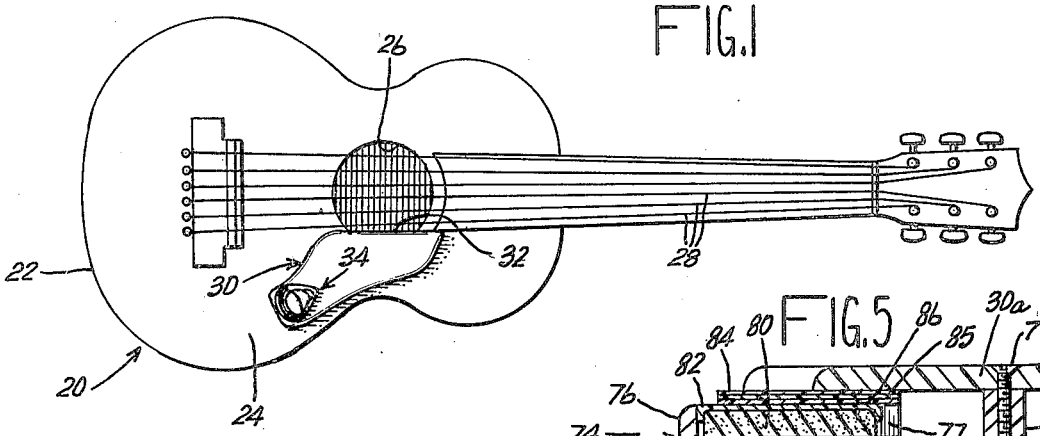
FIG.5
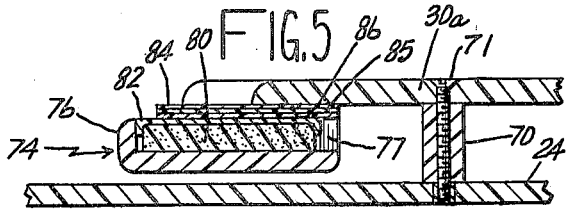
FIG.2
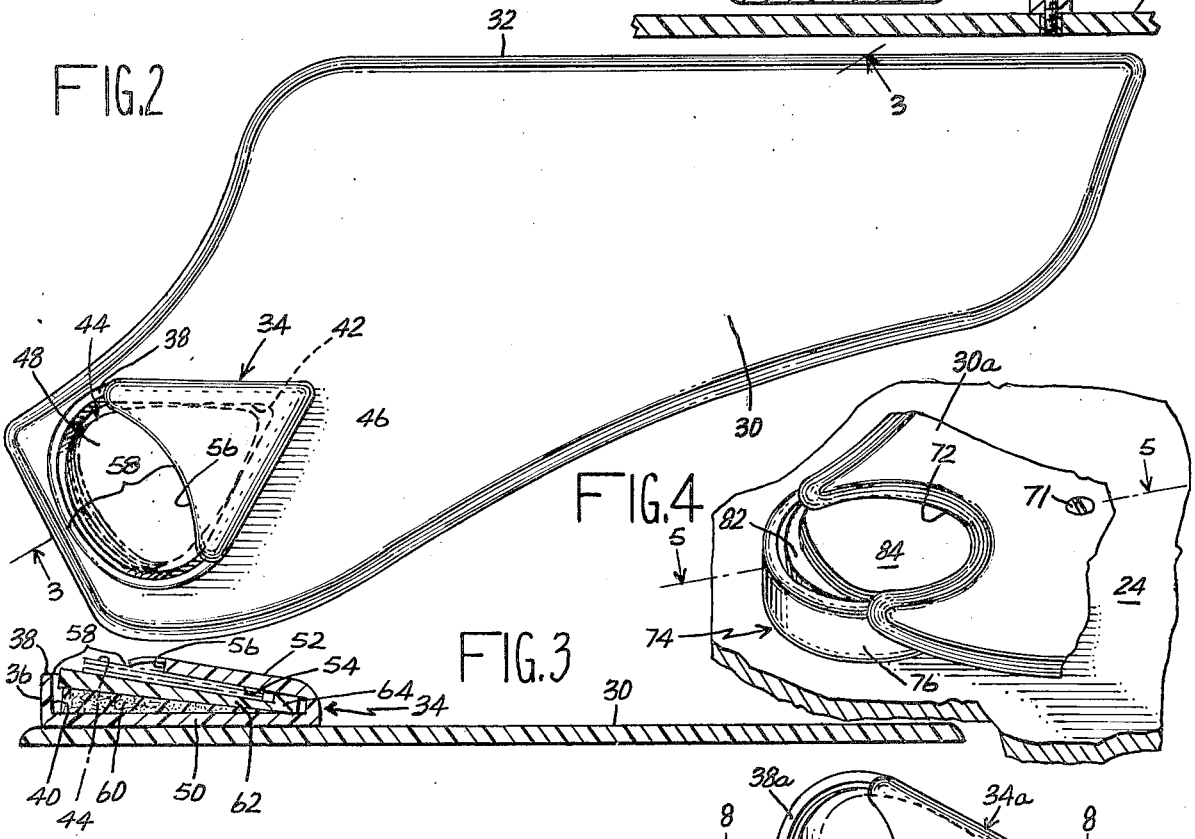
FIG.4
FIG.3
FIG.6
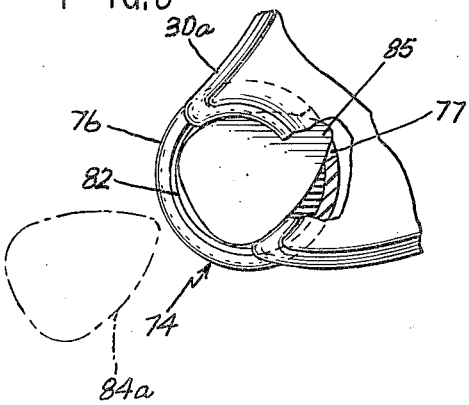
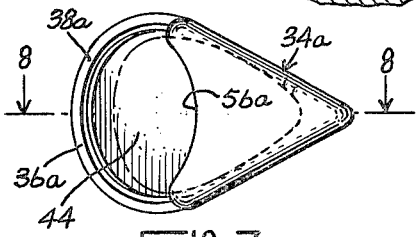
FIG.7
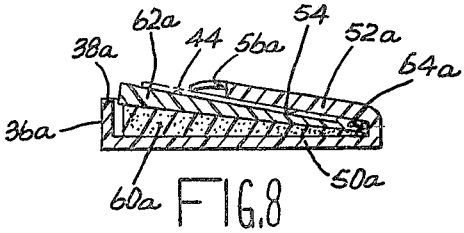
FIG.8

STRINGED MUSICAL INSTRUMENT PICK DISPENSER

BACKGROUND OF THE INVENTION

1. Field of the Invention

This invention is in the field of stringed instruments which are plucked. More particularly, this invention relates to a plucking pick dispenser mounted in fixed relation to the instrument, and to such a dispenser itself.

2. Description of the Prior Art

In stringed instruments, and in particular a guitar, the strings are often plucked with a small wafer-like pick having a generally triangular shape with the base of the pick being held in the musician's hand and the exposed pick apex being used to pluck one or more strings. In order for facile playing of the instrument, the pick ordinarily is of a small size and, frequently, especially during rapid plucking, the pick becomes dislodged from between the musician's fingers. In the past, upon such an occurrence, the musician was required to continue play using his thumb in place of the previously held pick. This ordinarily caused a perceptible difference in the musical sounds and also was an inconvenience to the musician. Spare picks were ordinarily unavailable in order for the musician to quickly and readily obtain a replacement without an interruption in the musical play.

SUMMARY OF THE INVENTION

A planar pick guard having a scuff resistant upper surface is mounted in relation to the sound board of a stringed musical instrument adjacent to and aligned with the last string in a group of strings to be played. The guard is so placed so as to be in position to prevent downward travel of a pick which is frequently used to pluck the strings of the instrument. A dispenser has a wall with upper and lower edges defining in cross-section the general configuration of a pick. The housing has a bottom side affixed to the lower edge of the wall and the top side affixed to the upper edge of the wall. The housing has a dispensative opening formed in the top side. The opening receives a pick having a generally triangular shape and provides an inner housing retaining surface which engages the pick. A pick surface is exposed through the opening and is presented for engagement with the musician's thumb for quick dispensatory withdrawal from the housing. The housing is mounted beneath the guard in one embodiment so that the exposed pick surface is substantially flush with the upper guard surface and is located in a position which would be in the path of the musician's hand at the end of a plucking stroke. Thus, if a pick becomes dislodged during play, the musician without missing a stroke can obtain a pick replacement which is presented to him for facile withdrawal and uninterrupted play.

A resilient sponge rubber is mounted in the housing and resiliently urges a pick support upwardly toward the opening. A pick is contained between the support and the retaining surface so that the pick is held against the retaining surface and the exposed pick surface is maintained substantially flush with the pick guard. Also, there is sufficient resiliency that two or more picks in a pick stack may be stored in the holder with removal of the top pick in the stack causing the stack remainder to move upwardly toward the opening thus presenting the next pick in proper position for ready withdrawal.

This invention also teaches utilizing a pick housing on existing pick guards by securing as with adhesive the bottom surface of the housing to the top surface of the guard. To facilitate withdrawal of the pick, the housing is ramp shaped so that a player's thumb will ride the ramp to the opening for rapid withdrawal of the pick from the dispenser. It is also possible in this manner to use the dispenser on an instrument which does not have a pick guard, and affixing the housing directly to the sound board.

It is also possible to use the pick housing to provide a portable dispenser which may be carried in the musician's pocket and thus minimize the difficulty in finding loose picks which are, as mentioned, generally wafer thin and relatively small.

It is therefore an object of this invention to provide a pick dispenser that will receive and retain one or more musical picks in position for ready withdrawal from the dispenser.

It is a further object of this invention to use a pick dispenser of the previous object in combination with a pick guard wherein a replacement pick may be quickly obtained during musical play without play interruption.

It is a still further object of this invention to provide a pick dispenser of the previous objects wherein the pick dispenser may be used on existing pick guards or on instruments that are without pick guards.

The above mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a top plan view of a stringed musical instrument having a dispenser of this invention mounted thereon;

FIG. 2 is an enlarged pick guard shown in FIG. 1 with the dispenser of this invention mounted thereon;

FIG. 3 is a section taken at 3—3 of FIG. 2;

FIG. 4 is a partial view in perspective of a second embodiment of this invention;

FIG. 5 is a section taken at 5—5 of FIG. 4;

FIG. 6 is a partial top elevational view of the embodiment of FIG. 4 showing a pick in dash-dot lines removed from the dispenser;

FIG. 7 is a top plan view of an unmounted dispenser of this invention; and

FIG. 8 is a section taken at 8—8 of FIG. 7.

DESCRIPTION OF THE PREFERRED EMBODIMENTS

Referring to FIGS. 1-3, a guitar 20 has a wind chest 22 with a sound board 24 mounted as the top surface thereof. Board 24 has sound hole 26 formed therein and strings 28 are mounted in tensioned parallel relation to guitar 20 traversing sound hole 26 in the conventional manner. A planar pick guard 30 is affixed directly to sound board 24 and is of a scuff resistant material, such as plastic, and has a first edge 32 which is aligned with lowermost string 28 and is in general registration with hole 26. The purpose of guard 30 is to intercept a pick or plectrum, used to pluck the strings 28 at the end of the plucking strum to thereby protect the surface of board 24 which frequently is of a highly finished wood material. Guards 30 of this nature are well known in the art.

A pick housing 34 which may be of a plastic material, has a perimetral wall 36 having upper edge 38 and lower edge 40. Wall 36 defines in cross-section a cavity 42 which is in the general configuration of a pick 44 which is generally triangular in shape and has an apex 46 which is used for plucking strings 28 and a base 48 which is gripped between the musician's thumb and finger. Pick 44 is generally of a plastic material and is wafer-thin.

Housing 34 has a lower side 50 which is affixed to the lower edge 40 of wall 36 and an upper side 52 which is affixed to the upper edge 38 of wall 36. Side 52 is in converging relation to side 50, for reasons later described, and has an inner retaining surface 54. Side 52 has a rearward edge 56 which together with the edge 38 of wall 36 defines an opening 58. A resilient member 60 has a wedge-shaped cross-section and may be made of foam or sponge plastic, and is placed above side 50 in housing 34. A support plate 62 having a lip 64 formed at one end thereof is placed in housing 34 and also has a wedge-shaped cross-section and has a configuration generally conforming to wall 36, as does member 60. Lip 64 is seated between sides 50 and 52 of housing 34 and acts as a spacer between the upper surface of support 62 and retaining surface 54 and also acts as a fulcrum for support plate 62 as picks 44 are inserted into and withdrawn from housing 34. Wall 36 retains member 60 and support 62 within housing 34.

The under surface of side 50 is attached to guard 30 as with tape having adhesive surfaces on both sides, or any other suitable adhesive material. Housing 34 is positioned on guard 30 at a location which is a continuation of the natural path of the musician's hand at the completion of a pick strum. In the embodiment shown, housing 34 is placed in the lower left corner of support 30. Since side 52 is in converging relation with side 50, the upper surface of side 52 provides a ramp over which the musician's thumb may travel on its way to engaging the top pick 44 held in housing 34. The opening 58 is located more remotely from edge 32 than is the retaining surface 54 which engages the top pick 44 in the pick stack held in housing 34 so that the dispensatory direction of the picks is in the direction of the strum path thus facilitating withdrawal of a pick 44 from holder 34.

Member 60 provides a substantially uniform resilient force along the entire undersurface of support 62. Other resilient members may be utilized in place of member 60. A stack of a plurality of picks 44 may be positioned in housing 34 with the lowermost pick 44 in the stack engaging the upper surface of support 62 and the uppermost pick 44 in the stack engaging retaining surface 54.

In those instruments not having a guard 30, the dispenser housing 34 may be affixed directly to board 24 at a suitable position, preferably in the strumming path continuation. Also, housing 34 may be molded integrally with guard 30.

In another embodiment, a guard **30*a* is mounted in spaced relation to the board 24, and is shown in FIGS. 4–6. Guard 30*a* is spaced from board 24 by spacers 70 secured by threaded bolts 71. In this embodiment, an end of guard 30*a* has formed therein edge 72 which defines a concavely formed opening. A dispenser housing 74 has a perimetral wall 76 defining a circular housing enclosure. Placed in the housing enclosure is a resilient member 80, which may be of a sponge or foam plastic, and which is generally configured to the inner dimensions of wall 76. Fittable over member 80 is a support plate 82 having a down-turned rim at its periphery which is configured to the inner dimensions of wall 76 and movable vertically therealong. A stack of picks 84 are placed in holder 74 with the lowermost pick 84 being in contact with the upper surface of support 82 and the uppermost pick 84 being in surface contact with retaining surface 86 which is on the underside of support 30*a*. Wall 76 has aperture 77 at one circumferential segment thereof for receiving the apex ends 85 of picks 84. The upper edge of wall 76 is affixed to the under surface of support 30*a* with a suitable adhesive, or alternatively, may be molded integrally with guard 30*a*. The orientation of housing 74 and removal of picks 84, one of which is shown in the removed position 84*a* in FIG. 6, is similar to that for the embodiment described in FIGS. 1–3**.

A further embodiment of this invention is shown in FIGS. 7 and 8 where a housing **34*a* is similar in configuration and construction, to housing 34 (FIGS. 1–3) and carries similar reference numerals with the addition of the suffix "a" for corresponding parts. The primary difference is that housing 34*a*** is adapted to be carried by the musician on his person so that the picks, which are small and wafer-thin, may be readily found and contained in a convenient dispenser. This minimizes the problems of wafer loss and search time in finding a wafer which otherwise could be lodged in a relatively inaccessible portion of the pocket interior. This not only facilitates pick retrieval but minimizes what may be an embarrassingly protracted pocket search.

While there have been described above the principles of this invention in connection with specific apparatus, it is to be clearly understood that this description is made only by way of example and not as a limitation to the scope of the invention.

What is claimed is:

1. A stringed musical instrument pick dispenser for a pick having a plucking apex end and an opposed base for musician gripping comprising:

a musical instrument having a sound board and a plurality of strings mounted in spaced relation to said board;

a pick dispenser housing being mounted to said instrument in predetermined relation to said strings;

said housing having a wall with upper and lower edges;

a bottom side being affixed to the lower edge of said wall and a top side being fixed to the upper edge of said wall defining an enclosure area for pick storage;

a dispensative opening being formed adjacent said top said to receive a pick, and the inner surface of said top side providing a retaining surface for engaging said pick;

said top side being inclined upwardly relative to said bottom side toward said opening;

resilient means being mounted in said housing for exerting a resilient force in a direction to urge a retained pick toward said opening, said resilient means comprising a wedge shaped member made of a sponge-like resilient plastic material generally conforming in shape to the shape of said enclosure area;

said housing being fixedly mounted relative to said sound board in a predetermined relation to the strings of the instrument.

* * * * *

UNITED STATES PATENT AND TRADEMARK OFFICE

CERTIFICATE OF CORRECTION

PATENT NO. : 4,135,431

DATED : January 23, 1979

INVENTOR(S) : Richard R. Ferguson

It is certified that error appears in the above-identified patent and that said Letters Patent are hereby corrected as shown below:

Claim 1, Col. 4, line 52 "said" should be -- side --

Signed and Sealed this

*Eighteenth* Day of *September 1979*

[SEAL]

*Attest:*

*Attesting Officer*

LUTRELLE F. PARKER

*Acting Commissioner of Patents and Trademarks*